US007315282B2

(12) United States Patent
Shr

(10) Patent No.: US 7,315,282 B2
(45) Date of Patent: Jan. 1, 2008

(54) MICRO-BELT ANTENNA

(75) Inventor: Shiuan-Guang Shr, Taipei (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/439,976

(22) Filed: May 25, 2006

(65) Prior Publication Data

US 2007/0273587 A1 Nov. 29, 2007

(51) Int. Cl.
*H01Q 1/38* (2006.01)

(52) U.S. Cl. ..... 343/700 MS; 343/846

(58) Field of Classification Search ..... 343/700 MS, 343/767, 829, 846
See application file for complete search history.

(56) References Cited

U.S. PATENT DOCUMENTS 4,006,481 A * 2/1977 Young et al. ..... 343/770
4,015,263 A * 3/1977 Koerner et al. ..... 343/708

* cited by examiner

*Primary Examiner*—Tho Phan
(74) *Attorney, Agent, or Firm*—Rosenberg, Klein & Lee

(57) ABSTRACT

An antenna includes a dielectric substrate, a radiator, and a grounding board. A chink is formed at the radiator and the chink is loaded with a resistor. The antenna of the present invention has the following merits. The chink on the radiator increases the current path of the radiator so as to increase the frequency bandwidth of the antenna. The resistor loaded in the chink can improve balance the gain balance in the bandwidth.

12 Claims, 3 Drawing Sheets frequency =5.4
main petal strength =5.9dBi
main petal orientation =5.0deg.
3dB angle bandwidth =66.2deg.

MICRO-BELT ANTENNA

BACKGROUND OF THE INVENTION

1. Field of the Invention

The present invention relates to an antenna. In particular, this invention relates to a micro-belt antenna that is small in size.

2. Description of the Related Art

Antennas are important elements in popular wireless electronic devices. Antennas are used to emit microwave signals generated by an electronic device, or receive microwave signals sent to the electronic device. Therefore, the quality of the antenna in the electronic device and whether the characteristic of the antenna matches the electronic device or not affect the emitting or receiving result of the antenna. Furthermore, the functions of the RF circuit and the digital circuit of the electronic device are also affected. Because the dimensions of antennas are becoming increasingly smaller, they require more receiving frequency periods, and as frequency bandwidth becomes larger, they also have to achieve improved quality. However, when an antenna has multiple frequency periods and a wider bandwidth antenna, the gain balance of the bandwidth worsens. If a microwave belt antenna that is large in size, for matching with the described requests, is designed, it goes against the trend of devices being lighter, thinner, and smaller, as is so often demanded by today's consumers.

SUMMARY OF THE INVENTION

One particular aspect of the present invention is to provide a micro-belt antenna that is small in size. The antenna has a smooth response in the multi-frequency periods and a wider bandwidth, and also has good gain balance within the wider bandwidth.

The antenna includes a dielectric substrate, a radiator, and a grounding board. A chink is formed at the radiator and the chink is loaded with a resistor.

The antenna of the present invention has the following merits. The chink on the radiator increases the current path of the radiator so as to increase the frequency bandwidth of the antenna. The resistor loaded in the chink can improve the gain balance in the bandwidth.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
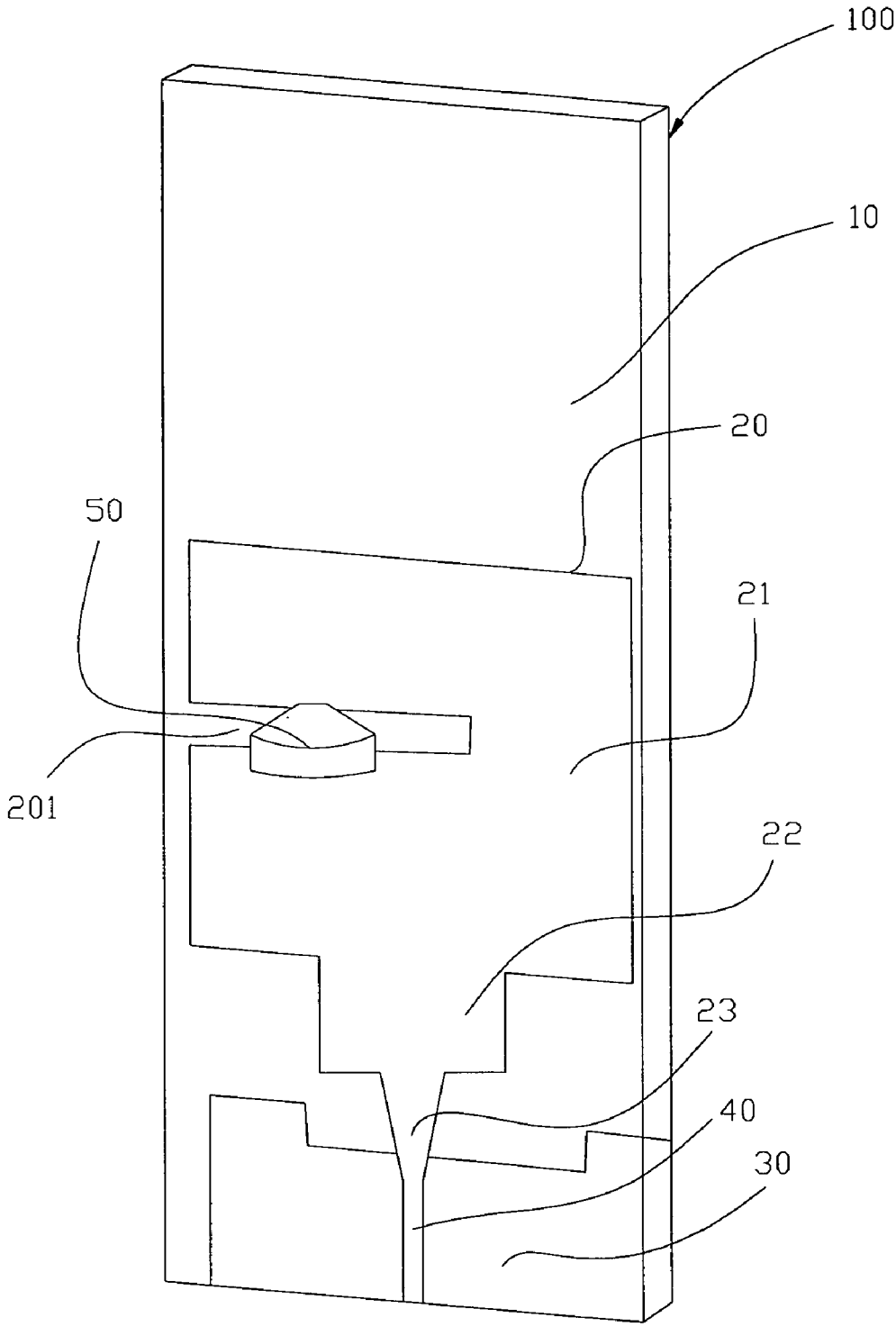
FIG. 1 is a perspective view of the appearance of the antenna of the present invention.

Reference is made to FIG. 1, which shows the antenna 100 of the present invention that is a small sized micro-belt antenna having a single pole. Its dimensions are less than or equal to 56 mm×12 mm×7.4 mm. The antenna 100 includes a dielectric substrate 10, a radiator 20, and a grounding board 30.

The antenna 100 is manufactured by individually forming the radiator 20 and the grounding board 30 on the two sides of the dielectric substrate 10 via manufacturing technology, such as an etching process. A micro-belt line 40 extends from the edge of one side of the radiator 20, and the micro-belt line 40 extends to the edge of the dielectric board 10. One end of the micro-belt line 40 is used as a signal inputting terminal of the antenna 100.

The dielectric board 10 is a rectangular microwave dielectric circuit board. In this embodiment, the dielectric board 10 is a rectangle (alternatively, it is also can be a circle or any other acceptable shape). The radiator 20 and the grounding board 30 are individually located on the two sides of the dielectric substrate 10. The length of the radiator 20 is less than the length of the dielectric board 10 minus the radiator 20.

The radiator 20 is a radiating metal flake. The radiator 20 includes three parts having different dimensions 21, 22 and 23. The biggest part 21 has a rectangular shape. On the left side of the rectangular part 21, there is an opening chink 201. The chink 201 is a traverse opening chink. A resistor 50 is loaded into the chink 201. The resistor 50 improves the ratio of voltage-to-standing wave and balances the gain balance in the bandwidth. When the resistance of the resistor 50 is around 100Ω, the S11 curve is the best one. A rectangular part 22 of a smaller size extends from the lower side of the rectangular part 21 having the biggest size. The rectangular part 22 is located at the middle of the lower side of the rectangular part 21 having the biggest size. A trapezoid part 23 having the smallest size extends from the middle of the lower side of the smaller rectangular part 22. The three parts 21, 22, and 23 of the radiator 20 having different sizes allow the antenna 100 to operate at three different frequency periods. A micro-belt line 40 extends from the edge of the lower side of the trapezoid part 23 of the radiator 20. The micro-belt line 40 extends to the edge of the dielectric board 10 and one end of the micro-belt line 40 is a signal inputting terminal.

The limited grounding board matches the grounding board 30 and the radiator 20 has a concave shape and is located at the lower side of the dielectric board 10 that corresponds to the micro-belt line 40. The size of the grounding board 30 is less than the size of the radiator 20.

Figure 2:
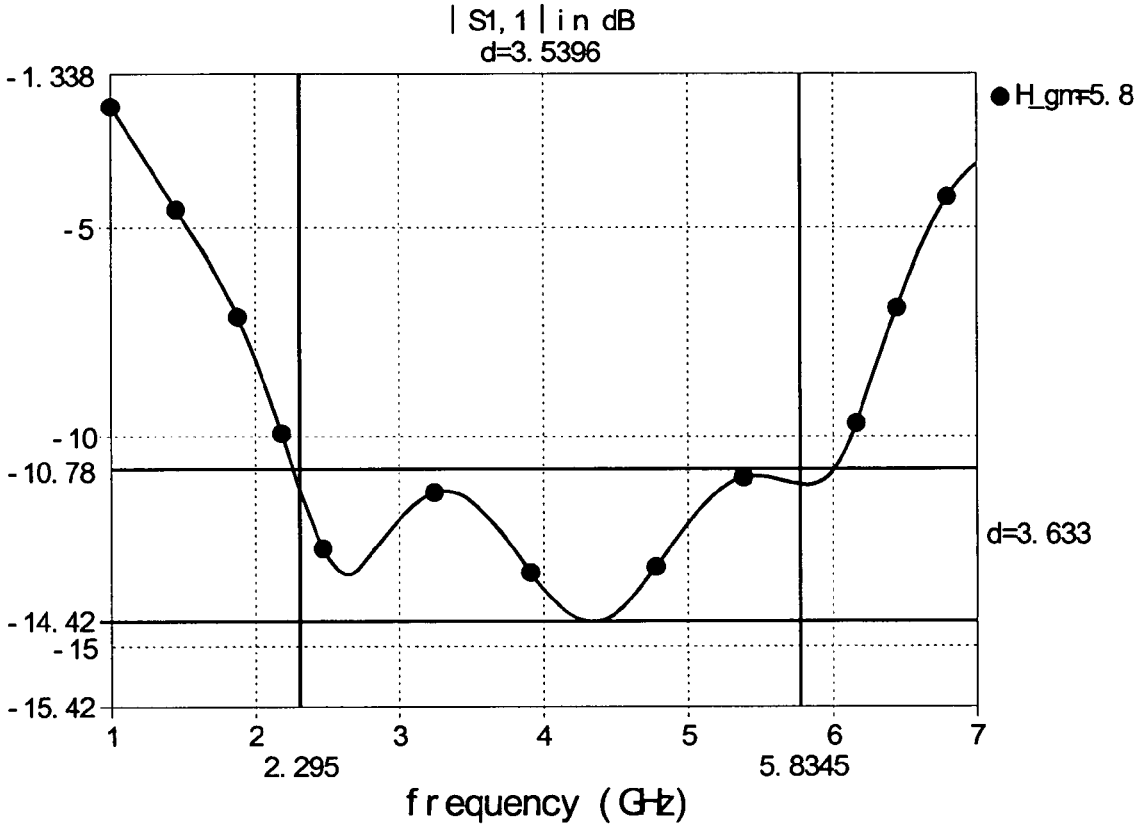
FIG. 2 is a curve diagram of an S11 curve of the antenna of the present invention generated by simulation software.
Figure 3:
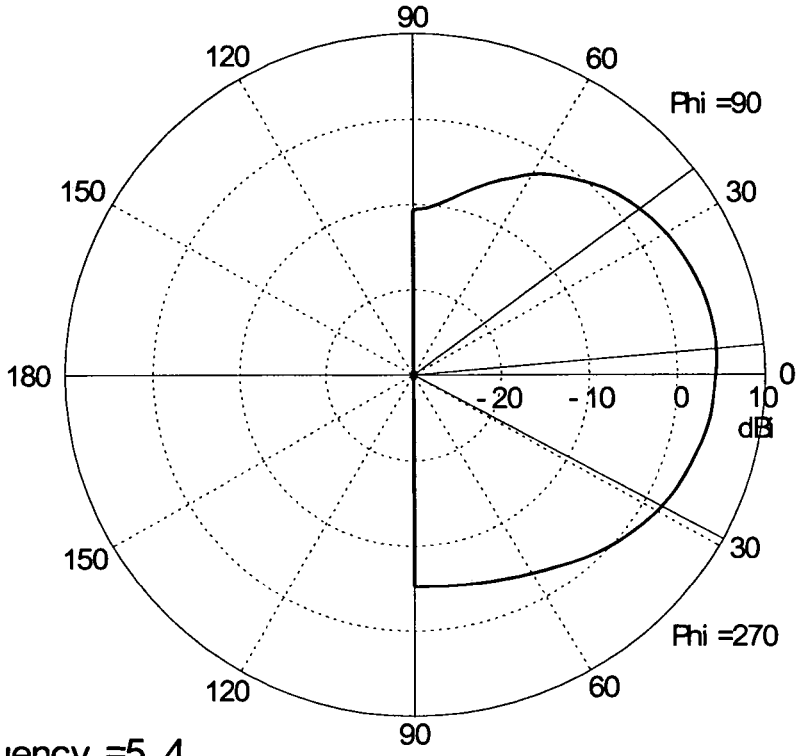
FIG. 3 is a far field diagram of a far field of the antenna of the present invention generated by simulation software.

When the antenna 100 is operated, a signal is inputted to the micro-belt line 40 from the signal output terminal of the system and the antenna 100 emits the signal, or the antenna 100 receives the signal and inputs the signal to the system via the micro-belt line 40. FIG. 2 is a diagram of an S11 curve of the antenna of the present invention generated by simulation software. A smallest loss and a best emitting efficiency for the antenna 100 is found between the frequency period ranging from 2.295 to 5.8345 GHz. As shown in FIG. 3, the antenna 100 has a better gain balance at 5.4 GHz. When the antenna 100 is operated at 2.3~2.7, 3.3~3.9, and 4.9~6 GHz, The loaded resistor 50 improves the ratio of voltage-to-standing wave in the bandwidth, the rectangular dielectric board 10, the radiator 20, and the grounding board 30 have a positive effect on the electromagnetic wave and the /S11/<-10 dB. Thereby, the antenna 100 has a better gain balance within the bandwidth. The antenna 100 is a small sized micro-belt antenna having a single pole. The antenna 100 has a smooth response effect within the bandwidth for multiple frequency periods. The size of the antenna 100 is less than or equal to 56 mm×12 mm×7.4 mm so that the antenna fits with the trend of electronic devices being lighter, thinner, and smaller.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. A micro-belt antenna, comprising:

a dielectric substrate;

a radiator, said radiator being a radiating metal flake and having three sections integrally formed with each other, each section thereof having a differing transverse dimension each taken with respect to the other for operation at three differing frequencies; and a grounding board;

wherein a chink is formed in one of said three sections of the radiator, said chink being loaded with a resistor.

2. The micro-belt antenna as claimed in claim 1, wherein the chink is a traverse opening chink on the radiator.

3. The micro-belt antenna as claimed in claim 1, wherein the chink is an opening chink on the radiator.

4. The micro-belt antenna as claimed in claim 1, wherein the length of the radiator is less than the length of the dielectric substrate without the radiator.

5. The micro-belt antenna as claimed in claim 1, wherein the size of the radiator is bigger than the size of the grounding board.

6. The micro-belt antenna as claimed in claim 1, wherein a micro-belt line extends from one side of the radiator to an edge of the dielectric substrate, an end thereon being a signal inputting terminal of the antenna.

7. The micro-belt antenna as claimed in claim 1, wherein the grounding board is disposed on a lower side of the dielectric substrate flanking a micro-belt line.

8. The micro-belt antenna as claimed in claim 1, wherein the grounding board is a limited grounding board matching the radiator.

9. The micro-belt antenna as claimed in claim 1, wherein the radiator and the grounding board are individually located at two sides of the dielectric substrate.

10. The micro-belt antenna as claimed in claim 1, wherein the antenna has a single pole.

11. The micro-belt antenna as claimed in claim 1, wherein the /S11/<-10 dB when the antenna is operated at 2.3~2.7 GHz, 3.3~3.9 GHz, and 4.9~6 GHz.

12. The micro-belt antenna as claimed in claim 1, wherein the size of the antenna is less than or equal to 56 mm×12 mm×7.4 mm.

* * * * *